US010082134B2

(12) United States Patent
Stones et al.

(10) Patent No.: US 10,082,134 B2
(45) Date of Patent: Sep. 25, 2018

(54) PUMPING SYSTEM

(71) Applicant: Edwards Limited, Crawley, West Sussex (GB)

(72) Inventors: Ian David Stones, Felbridge (GB); Malcolm William Gray, Crawley (GB); Iain David Port, Shoreham by Sea (GB)

(73) Assignee: Edwards Limited, Burgess Hill (GB)

( * ) Notice: Subject to any disclaimer, the term of this patent is extended or adjusted under 35 U.S.C. 154(b) by 235 days.

(21) Appl. No.: 14/767,534

(22) PCT Filed: Jan. 28, 2014

(86) PCT No.: PCT/GB2014/050209
§ 371 (c)(1),
(2) Date: Aug. 12, 2015

(87) PCT Pub. No.: WO2014/125249
PCT Pub. Date: Aug. 21, 2014

(65) Prior Publication Data

US 2015/0377226 A1 Dec. 31, 2015

(30) Foreign Application Priority Data

Feb. 13, 2013 (GB) ..... 1302530.9

(51) Int. Cl.
*F04B 37/14* (2006.01)
*F04B 41/02* (2006.01)
*F04B 41/06* (2006.01)

(52) U.S. Cl.
CPC ..... *F04B 37/14* (2013.01); *F04B 41/02* (2013.01); *F04B 41/06* (2013.01)

(58) Field of Classification Search
CPC ..... F04B 37/14; F04B 41/02; F04B 41/06
(Continued)

(56) References Cited

U.S. PATENT DOCUMENTS 4,850,806 A * 7/1989 Morgan ..... F04B 37/14 417/205
5,039,280 A 8/1991 Saulgeot et al.
(Continued)

FOREIGN PATENT DOCUMENTS

DE 19500823 A1 7/1996
EP 0373975 A1 6/1990
(Continued)

OTHER PUBLICATIONS

International Search Report and Written Opinion dated Jun. 4, 2014 in counterpart International Application PCT/GB2014/050209, 10 pgs.
(Continued)

*Primary Examiner* — Steven B McAllister
*Assistant Examiner* — Allen Schult
(74) *Attorney, Agent, or Firm* — Shumaker & Sieffert, P.A.

(57) ABSTRACT

A vacuum pumping system comprises a plurality of vacuum pumping arrangements for evacuating an enclosure and an auxiliary vacuum chamber for evacuation by at least one first vacuum pumping arrangement. The vacuum pumping system has a first state for evacuating the enclosure and a second state for conserving power consumed by the system. In a first stage of the second state the first vacuum pumping arrangement is arranged to evacuate an exhaust of at least one second vacuum pumping arrangement and in a second stage the exhaust of the first pumping arrangement is arranged to be evacuated by the auxiliary vacuum chamber.

11 Claims, 4 Drawing Sheets

(58) Field of Classification Search
USPC ..... 454/341
See application file for complete search history.

(56) References Cited

U.S. PATENT DOCUMENTS

| | | | | |
|---|---|---|---|---|
| 5,595,477 | A | 1/1997 | Amlinger | |
| 2004/0126244 | A1* | 7/2004 | Savidge | F04B 37/14 417/239 |
| 2008/0260545 | A1* | 10/2008 | Frokjaer | F04B 49/20 417/212 |
| 2010/0266433 | A1* | 10/2010 | Suzuki | F01C 21/02 418/9 |
| 2013/0028757 | A1* | 1/2013 | Stones | F04B 37/02 417/244 |

FOREIGN PATENT DOCUMENTS

| | | | | |
|---|---|---|---|---|
| EP | 1367260 | A2 * | 12/2003 | F04B 37/14 |
| JP | 2003139054 | A | 5/2003 | |
| WO | 2006097679 | A1 | 9/2006 | |
| WO | 2012066781 | A1 | 5/2012 | |

OTHER PUBLICATIONS

Combined Search and Examination Report under Sections 17 and 18(3) dated Jul. 30, 2013 in counterpart GB Application No. GB1302530.9, 5 pgs.
Translation of Office Action dated Jun. 1, 2017 in counterpart TW Application No. 103104619, 4 pps.

* cited by examiner

PUMPING SYSTEM

This application is a national stage entry under 35 U.S.C. § 371 of International Application No. PCT/GB2014/050209, filed Jan. 28, 2014, which claims the benefit of G.B. Application 1302530.9, filed Feb. 13, 2013. The entire contents of International Application No. PCT/GB2014/050209 and G.B. Application 1302530.9 are incorporated herein by reference.

TECHNICAL FIELD

The present invention relates to a vacuum pumping system for evacuating a chamber.

BACKGROUND

Vacuums are required for various purposes for example in the semiconductor processing industry or the manufacture of flat panel displays. A vacuum pumping system for generating a required vacuum may comprise a plurality of pumping arrangements which together evacuate an enclosure. Particularly, but not exclusively in the case of load lock chambers, chamber pressure cycles regularly between a relatively low vacuum and a relatively high vacuum. During part of the process cycle, when the relatively high vacuum is generated, the pumping arrangements continue to operate but are isolated from the enclosure. It is desirable to reduce the energy consumption of a vacuum pumping system in these and other circumstances.

SUMMARY

The present invention provides a vacuum pumping system comprising a plurality of vacuum pumping arrangements for evacuating an enclosure and an auxiliary vacuum chamber for evacuation by at least one first vacuum pumping arrangement, the vacuum pumping system having a first state for evacuating the enclosure and a second state for conserving power consumed by the system, wherein in a first stage of the second state said at least one first vacuum pumping arrangement is arranged to evacuate an exhaust of at least one second vacuum pumping arrangement and in a second stage the exhaust of said at least one first pumping arrangement is arranged to be evacuated by the auxiliary vacuum chamber.

The present invention also provides a vacuum pumping system comprising a plurality of vacuum pumping arrangements for evacuating an enclosure, the vacuum pumping system having a first state for evacuating the enclosure and a second state for conserving power consumed by the system, wherein in a first stage of the second state at least one first vacuum pumping arrangement is arranged to evacuate an exhaust of at least one second vacuum pumping arrangement and in a second stage the exhaust of said at least one first pumping arrangement is arranged to be evacuated by the exhaust of said at least one second pumping arrangement.

Other preferred and/or optional aspects of the invention are defined in the accompanying claims.

BRIEF DESCRIPTION OF DRAWINGS

In order that the present invention may be well understood, some embodiments thereof, which are given by way of example only, will now be described with reference to the accompanying drawings, in which.

DETAILED DESCRIPTION

Figure 1:
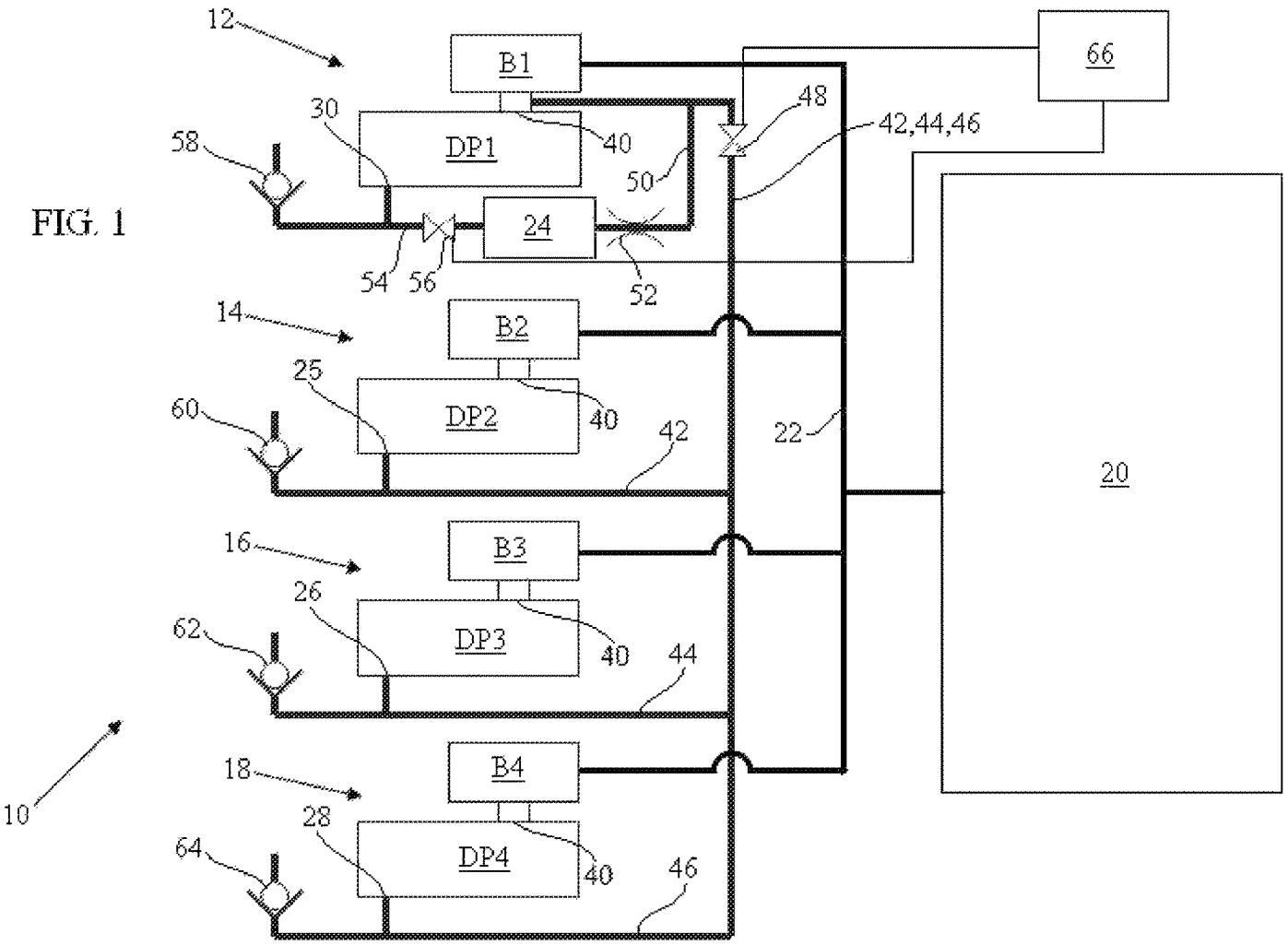
FIG. 1 shows schematically a vacuum pumping system.

Referring to FIG. 1, a vacuum pumping system 10 is shown which comprises a plurality of vacuum pumping arrangements 12, 14, 16, 18 for evacuating an enclosure 20. In this example, the vacuum pump arrangements each comprise a dry pump DP1, DP2, DP3, DP4 in series with an upstream booster pump B1, B2, B3, B4. A dry pump is a pump which is substantially free of lubricant along the pumped flow path. A booster pump is a pump which has a high pumping capacity or gas throughput but low compression ratio. Other vacuum pumping arrangements can be used, although the combination of a booster and dry pump is suited particularly to pumping down an enclosure quickly with reduced contamination of the enclosure. Inlets of the boosters are connected to the enclosure by pipework 22 so that the vacuum pumping arrangements evacuate the enclosure in parallel. Other configurations can be used but this parallel configuration is suited for rapid pump down of the enclosure which is useful for example if the enclosure is a load lock chamber and particularly a large volume load lock chamber for a flat panel display system.

In vacuum pumping applications, during evacuation of an enclosure a vacuum pumping system generates a flow of gas from the chamber and compresses the gas for exhausting typically at atmosphere. When the enclosure is at the target pressure the vacuum pumping system is typically isolated from the enclosure and at this time the pump is referred to in the art as operating at ultimate. At ultimate, there is substantially no flow through the vacuum pumping system. In the embodiments described herein, the vacuum pumping system consumes a reduced amount of energy when operating at ultimate compared to known vacuum pumping systems.

Referring again to FIG. 1, the vacuum pumping system has a first state for evacuating the enclosure and a second state for conserving power consumed by the system for example when operating at ultimate. In the first state, particularly in the case of a load lock chamber, or other similar enclosure, it is desirable to evacuate the chamber to a target pressure rapidly, since the time required for evacuation affects the cycle time and ultimately the manufacturing efficiency of vacuum processing of products, such as flat panel displays. In the second power conserving state the vacuum system is operated at ultimate. In the second state, the system reduces the pressure at the exhausts of the vacuum pumping arrangements thereby reducing the pressure, particularly at the exhaust stage where the pressure ratio is typically greatest and power consumption largest. The reduction in exhaust pressure reduces the energy required to operate the vacuum pumps.

In a first stage of the power conserving state a first of the vacuum pumping arrangements 12 is arranged to evacuate the exhausts 25, 26, 28 of the second vacuum pumping arrangements 14, 16, 18. In a second stage of the power conserving state the exhaust 30 of the vacuum pumping arrangement 12 is evacuated by an auxiliary vacuum chamber 24. In the example shown in FIG. 1, the auxiliary vacuum chamber has been previously evacuated by the vacuum pumping arrangement 12 (and particularly dry pump DP1).

In other examples, there may be a plurality of first vacuum pumping arrangements which in a first stage of the power conserving state are arranged to evacuate the exhausts of a plurality of second vacuum pumping arrangements and in the second stage the exhausts of the first vacuum pumping arrangements are arranged to be evacuated by the auxiliary vacuum chamber. A single auxiliary vacuum chamber is shown in FIG. 1 which is associated with the vacuum pumping arrangement 12, however more than one auxiliary vacuum pumping chamber can be used and associated with respective vacuum pumping arrangements.

The vacuum pumping arrangements 12, 14, 16, 18 each comprise an exhaust stage and at least one lower pressure stage and preferably a plurality of lower pressure stages. The various stages of each arrangement can be formed by separate pumps although in the example shown each arrangement comprises an upstream booster pump B1, B2, B3, B4 and a downstream multi-stage dry pump DP1, DP2, DP3, DP4. The pumping arrangement 12 is shown in more detail in FIG. 2. Arrangement 12 comprises pumping stages 32, 34, 36, 38. Stage 32 is the lowest pressure stage connected for receiving fluid from the inlet 40 of the dry pump DP1. Stages 34, 36 are progressively higher pressure stages and stage 38 is the exhaust stage. There may be any number of stages as required. The stages generally decrease in swept volume or pumping chamber size from the inlet 40 to the exhaust 30, although in other examples the volume of the stages may remain constant. The dry pump may comprise for example a roots or claw pumping mechanism having rotors disposed in stator chambers of each stage, although other types of pumping mechanism or combinations of mechanisms can be used. The vacuum pumping arrangements 14, 16, 18 are similar in construction to arrangement 12 as described above and therefore need not be described again.

Figure 2:
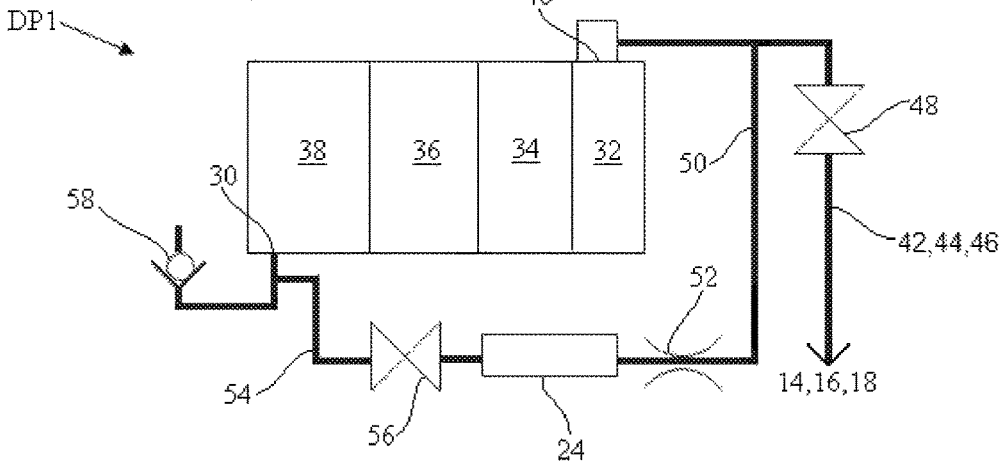
FIG. 2 shows schematically a vacuum pumping arrangement of the vacuum pumping system.

Referring to both FIGS. 1 and 2, in the first stage of the power conserving state the exhausts 25, 26, 28 of vacuum pumping arrangements 14, 16, 18 are arranged to be evacuated by a lower pressure stage 32, 34, 36 of the vacuum pumping arrangement 12. As shown, the exhausts are evacuated by the lowest pressure stage 32. As described in more detail below, evacuating the exhausts 25, 26, 28 by connection to the lowest pressure stage 32 produces the greatest reduction in exhaust pressure, however substantial reductions in power consumption can be achieved by reducing the exhausts to a relatively higher pressure by connecting them to intermediate pressure stages 34, 36.

As shown in FIGS. 1 and 2, the lowest pressure stage 32 of the vacuum pumping arrangement 12 is connected by second flow paths 42, 44, 46, to respective exhausts 25, 26, 28 of the second vacuum pumping arrangements. The flow paths are initially coterminous and then branch off separately to each of the exhausts. The second flow paths comprise a valve assembly 48 for allowing gas flow from the exhausts to the inlet 40 of dry pump DP1 in the first stage of the power conserving state and resisting flow in the second stage or the first state of the system. In an alternative arrangement, a valve may be associated with each of the flow paths 42, 44, 46.

Referring particularly to FIG. 2, the inlet 40 of the dry pump DP1 is connected by a first flow path 50 to the auxiliary vacuum chamber 24 for selectively evacuating the chamber. As is the case when evacuating the exhausts 25, 26, 28, the flow path 50 may be connected between the inlet 40 as shown or may be connected to a higher pressure intermediate stage 34, 36 of the dry pump DP1. More than one auxiliary chamber may be used for providing the auxiliary volume required.

In the example shown, the flow path 50 comprises a flow restriction 52 for restricting flow from the auxiliary vacuum chamber to the inlet 40 along the first flow path. The flow restriction may comprise an orifice of reduced size for reducing the conductance of the flow path. Whilst a valve can be used in place of the flow restriction, the flow restriction is currently preferred because it of simpler construction and does not require a control for opening and closing a valve. Additionally, the flow restriction decreases the rate of auxiliary chamber evacuation sufficiently that it can occur during enclosure evacuation without significantly affecting the rate of enclosure evacuation. If a valve is used it is closed during evacuation of the pump exhaust and open when the auxiliary chamber is evacuated, as explained in more detail below.

The exhaust 30 of the dry pump DP1 is connected by a third flow path 54 to the auxiliary vacuum chamber 24. The third flow path comprises a valve assembly 56 between the auxiliary vacuum chamber 24 and the exhaust 30 of the dry pump DP1. The valve assembly 56 is arranged to allow gas flow from the exhaust to the auxiliary chamber during the second stage of the power conserving state and to prevent gas flow when evacuating the enclosure in the first state of the vacuum pumping system. In this regard, during enclosure evacuation gas is pumped from the dry pump DP1 typically at atmosphere and exhausted for disposal or treatment. The pressure of the auxiliary chamber would equalise with the exhaust at atmosphere without the valve assembly. It is also preferred that the auxiliary chamber is evacuated prior to use of the system and then isolated until needed to improve power conservation at least in the first cycle. The valve assembly 56 allows isolation of the auxiliary chamber.

Four one way valves 58, 60, 62, 64 are located downstream of the exhausts 30, 25, 26, 28 of the vacuum pumping arrangements. The one way valves allow gas flow during enclosure evacuation during the first state of the system 10 so that gas evacuated from the enclosure can be exhausted to atmosphere or for treatment. The valves prevent gas flow in an opposing direction during the power conserving state when the exhausts are evacuated either by the dry pump DP1 or the auxiliary vacuum chamber 24.

A control 66 is operatively connected to the valve assemblies 48, 56 by control lines and arranged to control the timing at which the valve assemblies are opened and closed.

Figure 3:
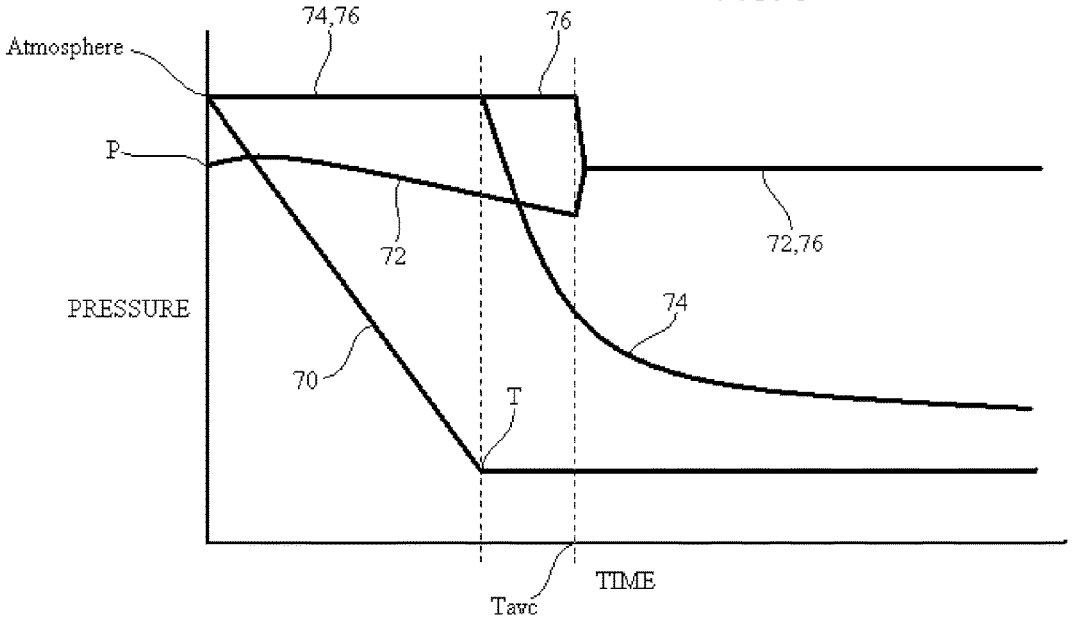
FIG. 3 is a graph of pressure against time for the vacuum pumping system.

Use of the system 10 will now be described with reference to FIGS. 1, 2 and 3. FIG. 3 is graph showing pressure over time for the pressure 70 of the enclosure, the pressure 72 of the auxiliary chamber, the pressure 74 of the exhausts of dry pumps DP2, DP3, DP4 and the pressure 76 of the exhaust of dry pump DP1.

The system 10 can be used for evacuating an enclosure 20, for example a load lock chamber of a vacuum processing system. In such a processing system, unprocessed products are loaded into a load lock chamber which is evacuated to a target pressure. The unprocessed products are transferred to a processing chamber at the target pressure. Following processing, processed products are transferred to the or another load lock chamber which is then vented to atmosphere for removal of the processed products. The load lock chamber therefore cycles between atmosphere and a target pressure. The system 10 is capable of conserving the consumption of power when such a load lock chamber is maintained at the target pressure. The system 10 is not limited for use in load lock chambers and can be used for other applications.

Referring particularly to FIG. 3, the enclosure pressure 70 is reduced from atmosphere to a target pressure T for example between about 10-2 and 1 mbar. Prior to commencing evacuation of enclosure 20, the auxiliary vacuum chamber 24 is evacuated to a predetermined pressure P which is between the target pressure and atmosphere. Preferably, the auxiliary chamber is evacuated to a pressure between 0.01 and 500 mbar and more preferably to about 100 mbar. The predetermined pressure selected is dependent on the volume of the chamber and the volume of the exhaust stages of the vacuum pumping arrangements as described in more detail below.

At commencement, valve assemblies 48 and 56 are closed by the control 66 and the vacuum pumping arrangements 12, 14, 16, 18 are operated to evacuate the enclosure. Evacuation is preferably rapid although there may be a 'slow start' over an initial period to avoid generating significant turbulence in the enclosure. Depending on its initial pressure, the pressure 72 of the auxiliary vacuum chamber 24 may increase over a short duration whilst it is below the pressure at the inlet 40 of the dry pump 1 and is then subsequently reduced in pressure, as shown in the graph. The restriction 52 limits the flow of gas from the auxiliary chamber to the inlet and therefore does not unduly affect ultimate enclosure pressure. If the enclosure is evacuated to about 1 mbar then the restriction may be configured to evacuate the auxiliary chamber to about 100 mbar.

As indicated above, the auxiliary chamber (and/or the exhausts of dry pumps DP2, DP3, DP4) may be connected to an intermediate pressure stage of dry pump DP1. In this way, the auxiliary chamber is not connected directly to the inlet 40 and can be evacuated to a pressure lower than the inlet even without the restriction. For example, the auxiliary chamber may be connected to stage 36 of the dry pump which is itself evacuated to about 100 mbar during normal use.

When the target pressure T in the enclosure has been attained, the valve assembly 48 is opened and the inlet 40 of the dry pump DP1 evacuates the exhausts 25, 26, 28 of dry pumps DP2, DP3. DP4. Any increase in pressure at inlet 40 is isolated from the enclosure by booster pump B1. In an alternative a valve may be used to isolate the enclosure.

The valve assembly 48 is controlled by the control 66. Opening of the valve assembly may occur a predetermined time after commencement of chamber evacuation or in response to a pressure sensor sensing that a target pressure has been attained. In a preferred example, opening of the valve assembly is controlled by the control which is responsive to the current of the drive of one or more of the dry pumps. In this latter regard, the supply voltage to the drive is generally constant and therefore the power consumed is proportional to the current. The current is high when pumping is commenced at low vacuum pressures and gradually decreases over time as the enclosure pressure approaches the target pressure and there is less gas to be pumped. The slope of the current against time curve is greater shortly after commencement and reduces towards the target pressure. Accordingly, in the present example, the point on the current-time curve which triggers opening of valve assembly 48 is selected where the rate of change of current is still large as this point is easier to identify than a point where the rate of change is small. Since the target pressure at the trigger point has not been attained a delay is introduced between the trigger point and opening the valve assembly to ensure that the target pressure has been attained prior to valve opening.

As shown in the graph of FIG. 3, the pressure 74 at the exhausts of the dry pumps DP2, DP3, DP4 decreases at a relatively quick rate initially when evacuation begins and then slows gradually over time. The reduction in power consumption is not proportional to the reduction in exhaust pressure and a greater saving can be achieved over the initial reduction in exhaust pressure from atmosphere compared to a reduction to much lower pressures. Therefore, in the present example, the valve assembly 56 is opened at a time 'Tavc' when the pressure at the exhausts 25, 26, 28 is still reducing relatively rapidly. At the time Tavc the current of the drives of dry pumps DP2, DP3, DP4 is reducing relatively rapidly and therefore the control 66 is readily responsive to the change in current for opening valve assembly 56.

When valve assembly 56 is opened, the pressure 76 at the exhaust 30 of the dry pump DP1 equalises with the pressure of the auxiliary vacuum chamber thereby reducing pressure at the exhaust and reducing power consumption. The reduction in exhaust pressure is dependent on the volume of the auxiliary vacuum chamber and the pressure prior to equalisation, together with the volume of the exhaust stage. Accordingly, the volume and pressure of the auxiliary vacuum chamber is selected to achieve a required reduction in exhaust pressure without unduly affecting enclosure evacuation. If for example the required pressure reduction in the exhaust stage is from 1000 mbar to 200 mbar and the volume of the exhaust stage is 'x' m3, then the auxiliary vacuum chamber may have a volume of '10x' m3 and a pressure of 120 mbar. It should also be considered that the volume of the exhaust stage includes the pipework between the exhaust and the valve assembly (which must also be evacuated) 56 and therefore the valve assembly 56 is located adjacent or as close as practical to the exhaust.

When the enclosure has been maintained at the target pressure T for the required period it is vented to increase its pressure to atmosphere. The cycle explained with reference to FIG. 3 then begins again.

The reduction in power consumption of the system 10 is dependent on a number of factors as explained above, such as pressure decrease at the exhausts 30, 25, 26, 28 and the period at which the system is operated at ultimate. However, savings of approximately 10 to 20% have been shown by experimentation.

Another vacuum pumping system 80 will now be described with reference to FIG. 4. Like reference numerals will be used for the aspects of system 80 which are common to system 10, and explanation of those common aspects will be omitted to avoid repetition.

Figure 4:
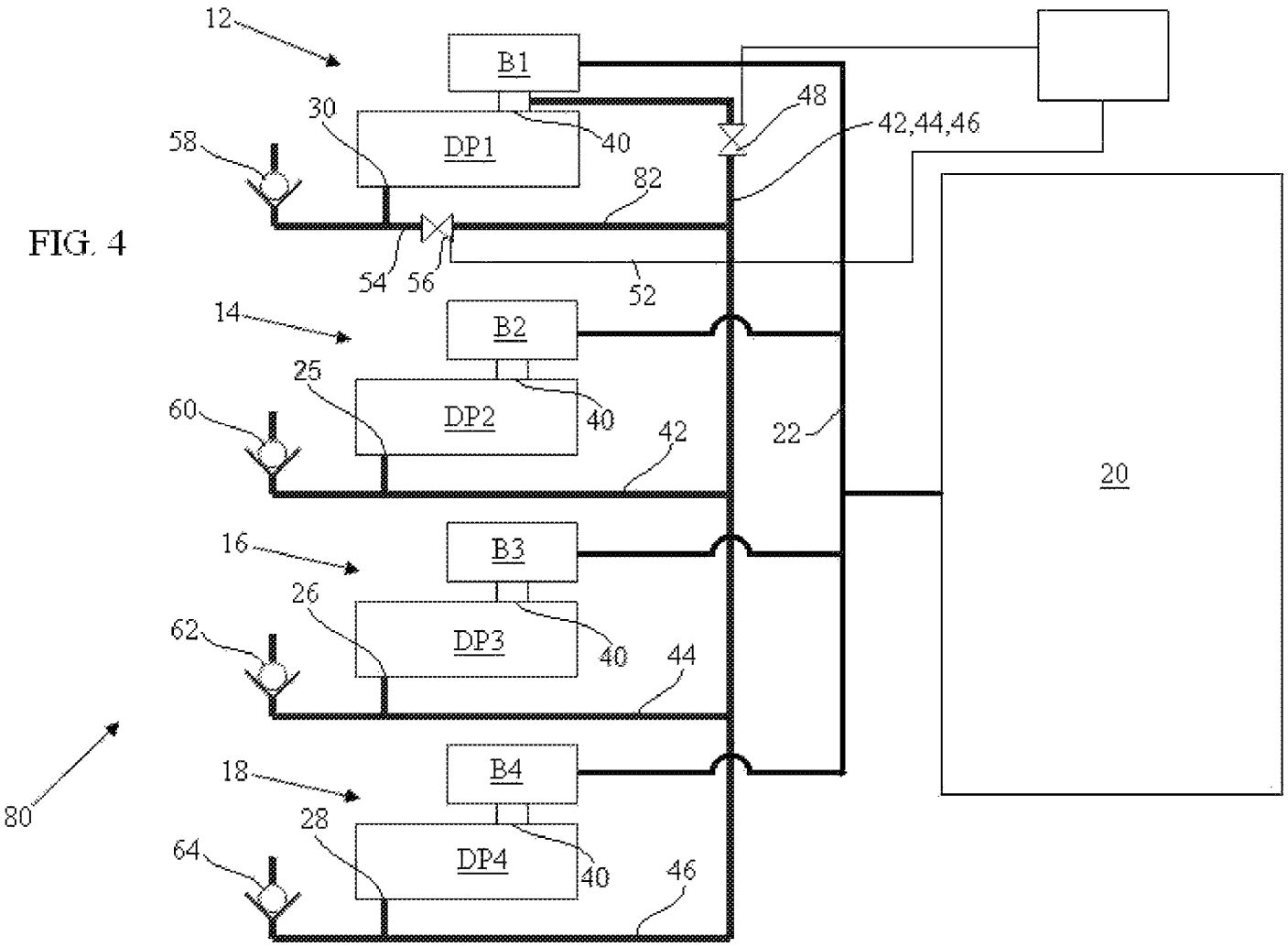
FIG. 4 shows schematically another vacuum pumping system.

Referring to FIG. 4, the vacuum pumping system 80 has a first stage of a power conserving state which is similar to the first stage of system 10 and in which one or more first vacuum pumping arrangements are arranged to evacuate the exhausts of one or more second vacuum pumping arrangements. In FIG. 4, the dry pump DP1 of vacuum pumping arrangement 12 is arranged to evacuate the exhausts 25, 26, 28 of the vacuum pumping arrangements 14, 16, 18. However, system 80 does not comprise an auxiliary vacuum pumping chamber and instead the auxiliary vacuum volume is provided by the exhausts of the second vacuum pumping arrangements. Therefore, in a second stage of the power conserving state the exhausts of one or more of the first pumping arrangements are arranged to be evacuated by the exhausts of one or more of the second pumping arrangements. In FIG. 4, the exhaust 30 of dry pump DP1 is arranged to be evacuated by the exhausts 25, 26, 28 of the dry pumps DP2, DP3, DP4.

Figure 5:
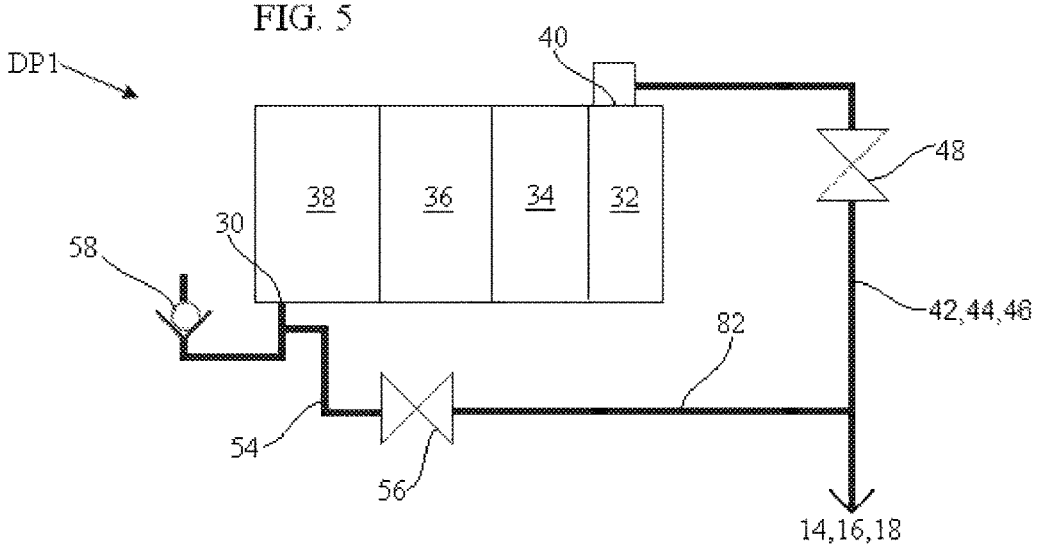
FIG. 5 shows a vacuum pumping arrangement of the vacuum pumping system shown in FIG. 4.

As described with reference to FIG. 5, the vacuum pumping arrangements each comprise an exhaust stage 38 and at least one lower pressure stage 32, 34, 36, and the exhausts 25, 26, 28 of the second vacuum pumping arrangements 14, 16, 18 are evacuated by one of the lower pressure stages 32, 34, 36 of the or each first vacuum pumping arrangement. In FIGS. 4 and 5, a single first vacuum pumping arrangement 12 is arranged to evacuate the exhausts of the second vacuum pumping arrangements. The lowest pressure stage 32 or inlet 40 of the first vacuum pumping arrangement 12 is connected by first flow paths 42, 44, 46 to the exhausts of the second vacuum pumping arrangements and the exhausts of the second pumping arrangements are connected by second flow paths 82 to the exhaust 30 of the first vacuum pumping arrangement 12. The first flow path comprises a first valve assembly 48 for allowing gas flow along the first flow paths in the first stage of the power conserving state and resisting gas flow in the second stage. The second flow paths comprise a second valve assembly 56 for allowing gas flow along the second flow path 82 in the second stage of the power conserving state and resisting gas flow in the first stage.

In use, the first stage of the power conserving state is similar to that of system 10 and need not be described again. In the second stage, the exhaust stage of the first vacuum pumping arrangement 12 is connected to the previously evacuated exhaust stages of the second vacuum pumping arrangements 14, 16, 18 by opening valve assembly 56. When valve assembly 56 is opened the pressure in the exhaust stages of the first and second vacuum pumps equalise and power consumption is reduced. Valve assembly 48 is closed at this stage otherwise the inlet 40 of dry pump DP1 will be connected to the exhaust of the dry pump.

The system 80 does not conserve power to the same extent as system 10 but is simpler in construction and lower cost.

The invention claimed is:

1. A vacuum pumping system comprising:

a plurality of vacuum pumping arrangements for evacuating an enclosure;

a first state for evacuating the enclosure; and a second state for conserving power consumed by the vacuum pumping system, wherein:

in a first stage of the second state, at least one first vacuum pumping arrangement of the plurality of vacuum pumping arrangements is arranged to evacuate an exhaust of at least one second vacuum pumping arrangement of the plurality of vacuum pumping arrangements; and in a second stage of the second state, the exhaust of the at least one first pumping arrangement is arranged to be evacuated by an exhaust conduit of the at least one second pumping arrangement.

2. The vacuum pumping system of claim 1, wherein the plurality of vacuum pumping arrangements comprise a single first vacuum pumping arrangement and a plurality of second vacuum pumping arrangements, and wherein, in the first stage, the single first vacuum pumping arrangement is arranged to evacuate the respective exhausts of the second vacuum pumping arrangements and, in the second stage, the exhaust of the single first vacuum pumping arrangement is arranged to be evacuated by the respective exhaust conduits of the second vacuum pumping arrangements.

3. The vacuum pumping system of claim 2, wherein the plurality of vacuum pumping arrangements each comprise an exhaust stage and at least one lower pressure stage, and the respective exhausts of the second vacuum pumping arrangements are evacuated by the at least one lower pressure stage of the single first vacuum pumping arrangement.

4. The vacuum pumping system of claim 3, wherein the at least one lower pressure stage of the single first vacuum pumping arrangement is connected by a first flow path to the respective exhausts of the second vacuum pumping arrangements and the respective exhausts of the second pumping arrangements are connect by second flow paths to the exhaust of the single first vacuum pumping arrangement.

5. The vacuum pumping system of claim 4, wherein the first flow path comprises a first valve assembly for allowing gas flow along the first flow path in the first stage and resisting gas flow in the second stage.

6. The vacuum pumping system of claim 4, wherein the second flow paths comprise a second valve assembly for allowing gas flow along the second flow paths in the second stage and resisting gas flow in the first stage.

7. The vacuum pumping system of claim 1, wherein the second state is implemented at a target pressure of the enclosure.

8. The vacuum pumping system of claim 1, wherein the plurality of vacuum pumping arrangements each comprise a multi-stage dry pump and an upstream booster pump connected in series.

9. The vacuum pumping system claim 1, wherein the plurality of vacuum pumping arrangements are configured in parallel to one another for evacuating the enclosure.

10. The vacuum pumping system of claim 5, wherein the second flow paths comprise a second valve assembly for allowing gas flow along the second flow paths in the second stage and resisting gas flow in the first stage.

11. The vacuum pumping system of claim 2, wherein the second state is implemented at a target pressure of the enclosure.

* * * * *